US010241445B2

(12) United States Patent
Mizukoshi et al.

(10) Patent No.: US 10,241,445 B2
(45) Date of Patent: Mar. 26, 2019

(54) IMAGE FORMING APPARATUS

(71) Applicant: CANON KABUSHIKI KAISHA, Tokyo (JP)

(72) Inventors: Shunsuke Mizukoshi, Yokohama (JP); Takaaki Shinkawa, Yokohama (JP); Jun Miura, Kawasaki (JP); Takahiro Ikeda, Oyama (JP); Yuji Kawaguchi, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/868,106

(22) Filed: Jan. 11, 2018

(65) Prior Publication Data

US 2018/0136591 A1 May 17, 2018

Related U.S. Application Data

(62) Division of application No. 15/067,659, filed on Mar. 11, 2016, now Pat. No. 9,897,942.

(30) Foreign Application Priority Data

Mar. 12, 2015 (JP) ..... 2015-050047

(51) Int. Cl.
*G03G 15/16* (2006.01)
*G03G 15/01* (2006.01)

(52) U.S. Cl.
CPC ..... *G03G 15/1605* (2013.01); *G03G 15/0136* (2013.01); *G03G 15/1675* (2013.01)

(58) Field of Classification Search
CPC ..... G03G 15/0136; G03G 15/1605; G03G 15/1675
See application file for complete search history.

(56) References Cited

U.S. PATENT DOCUMENTS 6,771,924 B2 8/2004 Matsuguma
8,891,993 B2 11/2014 Kanari et al.
(Continued)

FOREIGN PATENT DOCUMENTS

JP 06-258914 A 9/1994
JP 2001-356642 A 12/2001
(Continued)

OTHER PUBLICATIONS

Office Action dated Nov. 27, 2018, in Japanese Patent Application No. 2015-050047.

*Primary Examiner* — Hoang Ngo
(74) *Attorney, Agent, or Firm* — Venable LLP

(57) ABSTRACT

An image forming apparatus operable in a mode of forming an image using only a part of image forming stations. In the mode, a developing device contacts an image bearing member in a part of the image forming stations, and the developing device is spaced from the image bearing member in the rest of the image forming stations. The contact pressure between the image bearing member and a transferring device is made smaller in the rest than in the part. The image forming operation in the mode is executed while the image bearing members of the part and the rest are rotated. A controller is configured such that when the operation in the mode is continuously executed for a time period longer than a predetermined period, the contact pressure in the rest is made larger than the above-mentioned smaller contact pressure.

14 Claims, 9 Drawing Sheets

(56) References Cited

U.S. PATENT DOCUMENTS

| | | | |
|---|---|---|---|
| 9,170,555 | B2 | 10/2015 | Kanari et al. |
| 9,182,707 | B2 | 11/2015 | Morihara et al. |
| 9,207,563 | B2 | 12/2015 | Fujioka |
| 9,897,942 | B2 * | 2/2018 | Mizukoshi ..... G03G 15/1605 |
| 2003/0063928 | A1 | 4/2003 | Matsuguma |
| 2010/0046997 | A1 | 2/2010 | Gross et al. |
| 2010/0196030 | A1 | 8/2010 | Okubo et al. |
| 2011/0150512 | A1 | 6/2011 | Tamagaki |
| 2012/0275807 | A1 | 11/2012 | Kanari et al. |
| 2014/0314431 | A1 | 10/2014 | Morihara et al. |
| 2015/0192877 | A1 | 7/2015 | Fujioka |

FOREIGN PATENT DOCUMENTS

| | | | |
|---|---|---|---|
| JP | 2003-076103 | A | 3/2003 |
| JP | 2009-271163 | A | 11/2009 |
| JP | 2010-002565 | A | 1/2010 |
| JP | 2010-181780 | A | 8/2010 |
| JP | 2011-150311 | A | 8/2011 |
| JP | 2012-233994 | A | 11/2012 |
| JP | 2013-156446 | A | 8/2013 |
| JP | 2014-021261 | A | 2/2014 |
| JP | 2014-071435 | A | 4/2014 |
| JP | 2015-034968 | A | 2/2015 |

* cited by examiner (a)

(b)

IMAGE FORMING APPARATUS

FIELD OF THE INVENTION AND RELATED ART

The present invention relates to an image forming apparatus such as a copying machine, a printer, a facsimile machine and so on using an electrophotographic type process or electrostatic recording type process.

In a conventional image forming apparatus of the electrophotographic type or electrostatic recording type, a toner image is formed through an image formation process on an image bearing member such as an electrophotographic photosensitive member or a dielectric member for electrostatic recording, in the form of a drum or a belt. The toner image is transferred onto a recording material by a transferring device. The transferring device includes a recording material carrying member or an intermediary transfer member and transfers the toner image directly onto the recording material fed by the recording material carrying member or transfers temporarily the toner image onto an intermediary transfer member (primary-transfer) and then is transferred onto the recording material (secondary-transfer).

As for such an image forming apparatus, there is a tandem type image forming apparatus comprising independent image forming stations for forming the toner images in yellow, magenta, cyan and black colors, respectively. A developing system for developing an electrostatic latent image formed on the image bearing member in each of the image forming stations may be a contact-type developing system which effects the developing operation in the state that the image bearing member and the developing device are in contact with each other.

The tandem type image forming apparatus may be operable in a mode in which the image is formed only by a part of the image forming portions. A known apparatus is operable in one of two modes, in one of which the image formation is carried out using all of the image forming stations (full color mode), in the other of which a monochromatic image (black monochromatic image) is formed using the image forming station for the black color.

It is known that when the image is formed using only a part of the image forming stations, the developing device is spaced from the image bearing member in the image forming station or stations not to be used. With such a method, the contact period between the image bearing member and the developing device in the image forming station which does not form the image is reduced, so that the deterioration of the image bearing member and/or the developing device can be suppressed. In addition, the rubbing of the toner existing in the contact portion between the image bearing member and the developing device is reduced, so that the deterioration of the toner can be suppressed, and in addition, the toner consumption can be reduced because the deteriorated toner consumed by depositing to the image bearing member in the image background area.

In addition, it is known that when the image is formed using only a part of the image forming stations, the image bearing member and the intermediary transfer member or the recording material carrying member are spaced apart from each other (Japanese Laid-open Patent Application Hei 6-258914). With such a method, the contact period between the image bearing member and the transferring device is reduced, so that the service life of the image bearing member can be extended.

Furthermore, recently, for the purpose of a further downsizing or cost reduction of the image forming apparatus, a common driving source for the plurality of image bearing members is used.

SUMMARY OF THE INVENTION

However, in the image forming apparatus in which when the image formation is effected only a part of the image forming stations, the developing device and the transfer device are spaced from the image bearing member in the image forming station not used for the image formation, a so-called "cleaning blade noise" may be produced.

More particularly, in the conventional image forming apparatus, a cleaning blade of an elastic material is contacted to the surface of the image bearing member to scrape the toner remaining on the image bearing member at the image transfer off the surface. Normally, the toner and/or externally added material of the toner is fed into the contact portion between the image bearing member and the cleaning blade and function as a lubricant to reduce the friction between the image bearing member and the cleaning blade.

However, in the case that the developing device is spaced from the image bearing member in the image forming station not forming the image, the toner or the externally added material functioning as the lubricant is not supplied into the contact portion between the image bearing member and the cleaning blade in such an image forming station. If the image bearing member is rotated in the image forming station not forming the image because of the use of the common driving source for the plurality of image bearing members, the continuous rotation of the image bearing member results in gradual increase of the friction between the cleaning blade and the image bearing member. Then, the vibration of the cleaning blade and the image bearing member increases with the result of production of noise.

If the transferring device is contacted to the image bearing member, the vibration of the cleaning blade is reduced by the intermediary transfer member or the recording material carrying member contacted to the image bearing member, and therefore, the cleaning blade noise does not tend to occur. However, in an image forming apparatus, the transferring device is spaced from the image bearing member in the image forming station not forming the image. In such a case, in the image forming station not forming the image, it is not possible to suppress the vibration of the cleaning blade through the image bearing member by the intermediary transfer member or the recording material carrying member, and the cleaning blade noise may be produced.

In the foregoing description, an example has been taken in which the transferring device is spaced from the image bearing member in the image forming station not forming an image. In the image forming apparatus, the transferring device is contacted to the image bearing member with a reduced contact pressure therebetween in the image forming station not forming the image. In such a case, the cleaning blade noise tends to occur in the image forming station not forming the image, as well.

Accordingly, it is an object of the present invention to provide an image forming apparatus by which the deterioration or the like of the member constituting the image forming station can be suppressed, and the production of the noise caused by the cleaning member can be suppressed.

According to an aspect of the present invention, there is provided an image forming apparatus comprising a plurality of image forming stations each including a rotatable image bearing member, a developing device configured to develop an image on said image bearing member with a developer, said developing device being capable of contacting to and spacing from said image bearing member, and a cleaning member contacted to said image bearing member and configured to remove the developer from said image bearing member; a transferring device configured to transfer the images formed on said image bearing members of said image forming stations onto a recording material; a contacting/spacing device provided for at least one of said image forming stations and configured to space said developing device from said image bearing member of said at least one of said image forming stations and to contact said developing device to said image bearing member of said at least one of said image forming stations; a changing device provided for said at least one of said image forming stations and configured to change a contact pressure between said image bearing member and said transferring device, wherein said image forming apparatus is operable in a mode in which the image is formed by only a part of said image forming stations, and no image is formed by the rest of said image forming stations, wherein in the mode, said developing device contacts said image bearing member in the part of said image forming stations, said developing device is spaced from said image bearing member in the rest of said image forming stations, and the contact pressure between said image bearing member and said transferring device is made smaller in the rest of said image forming stations than in the part of said image forming stations, and wherein an image forming operation in the mode is executed while said image bearing members of the part and the rest of said image forming stations are rotated; and a controlling device configured to control said changing device such that when the image forming operation in the mode is continuously executed for a time period longer than a predetermined period, the contact pressure in the rest of said image forming stations is made larger than the above-mentioned smaller contact pressure.

Further features of the present invention will become apparent from the following description of exemplary embodiments with reference to the attached drawings.

DESCRIPTION OF THE EMBODIMENTS

The embodiments of the present invention will be described in detail in conjunction with the accompanying drawings.

Embodiment 1

Figure 1:
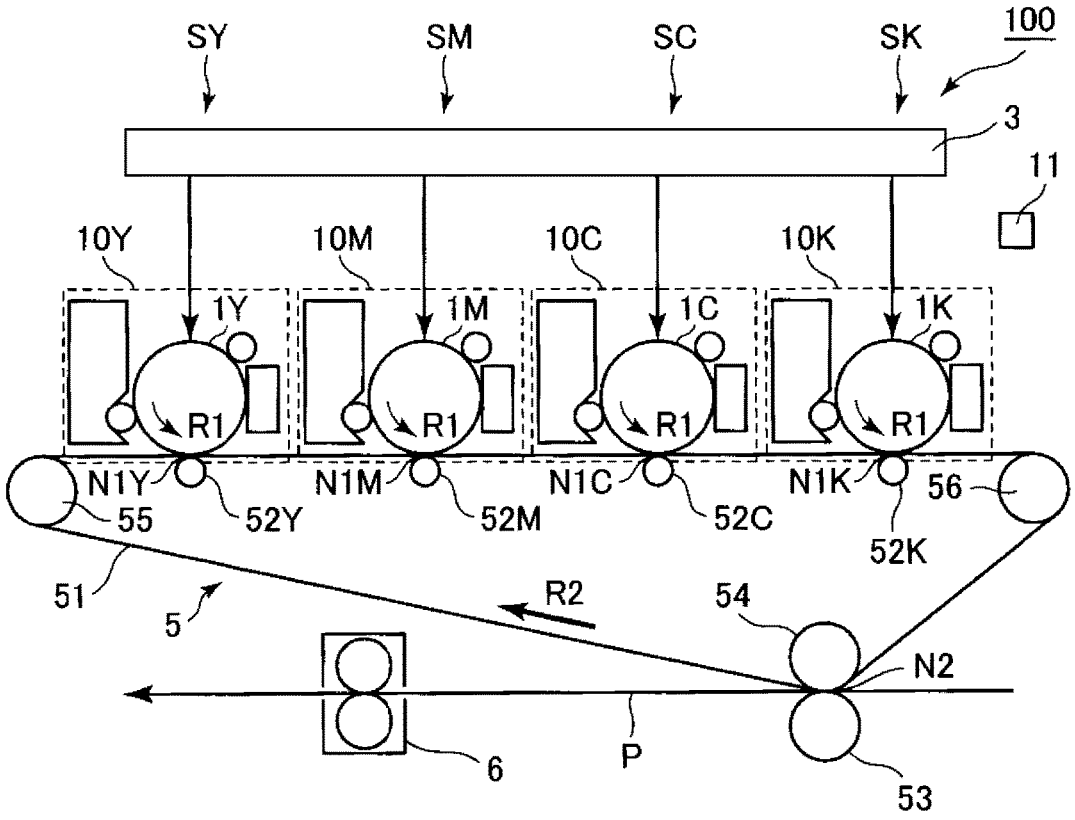
FIG. 1 is a schematic sectional view of an image forming apparatus.

1. General Arrangement of Image Forming Apparatus:

FIG. 1 is a schematic sectional view of an image forming apparatus 100 according to an embodiment of the present invention. The image forming apparatus 100 of this embodiment is a tandem type, electrophotographic type and intermediary transfer type color laser beam printer capable of forming a full-color image.

The image forming apparatus 100 comprises first, second, third and fourth image forming stations SY, SM, SC and SK as a plurality of image forming stations. The image forming stations SY, SM, SC, SK form yellow (Y), magenta (M), cyan (C) and black (K) images, respectively.

The image forming stations have fundamentally the same structures, and therefore, the following description of the image forming stations applies commonly to them, although suffixes Y, M, C and K are added in the drawings and only when necessary. Some elements for the colors may be added with Y, M, C, and K at the top.

The image forming station S of the image forming apparatus 100 comprises a process cartridge 10 detachably mountable to a main assembly A of the image forming apparatus 100. The process cartridge 10 includes a photosensitive drum 1 which is an electrophotographic photosensitive member (photosensitive member) of a drum type (cylindrical) as an image bearing member which is rotatable in the direction indicated by an arrow R1. The process cartridges 10Y, 10M, 10C, 10K contain yellow, magenta, cyan and black toner particles, respectively. The image forming apparatus 100 includes an exposure device (laser beam scanner) 3 as exposure means for exposing the photosensitive drum 1 of the process cartridge 10. In this embodiment, the image forming station S is constituted by the process cartridge 10 and the exposure device 3 for exposing the photosensitive drum 1 of the process cartridge 10.

The image forming apparatus 100 comprises a transferring device 5 for transferring the images formed by the image forming stations S onto a recording material P. The transferring device 5 includes an intermediary transfer belt 51 in the form of an endless belt as an intermediary transfer member capable of traveling along an endless path in the direction indicated by an arrow R2 in the Figure. The intermediary transfer belt 51 is extended around a secondary transfer opposing roller 54, a driving roller 55 and a tension roller 56. The transferring device 5 includes primary transfer rollers 52Y, 52M, 52C, 52K which are primary transfer members in the form of rollers as primary transferring means, provided inside the intermediary transfer belt 51, corresponding to the respective process cartridges 10Y, 10M, 10C, 10K. The primary transfer roller 52 is urged toward the photosensitive drum 1 through the intermediary transfer belt 51 to establish a primary transfer portion (primary transfer nip) N1 where the intermediary transfer belt 51 contacts the photosensitive drum 1. The primary transfer roller 52 is movable to contact the intermediary transfer belt 51 to the photosensitive drum 1 and to space the intermediary transfer belt 51 from the photosensitive drum 1. The transferring device 5 includes a secondary transfer roller 53 which is a secondary transfer member as secondary transferring means at a position facing the secondary transfer opposing roller 54 at the outer peripheral surface of the intermediary transfer belt 51. The secondary transfer roller 53 is urged toward the secondary transfer opposing roller 54 through the intermediary transfer belt 51 to establish a secondary transfer portion (secondary transfer nip) N2 where the secondary transfer roller 53 contacts the intermediary transfer belt 51. The intermediary transfer belt 51, the primary transfer rollers 52*y*, 52*m*, 52*c* and 52*b*, and the secondary transfer roller 53 are parts of transferring device 5 for transferring a toner image from the photosensitive drum 1 onto the recording material P.

The image forming apparatus 100 further comprises a feeding device (unshown) for feeding the recording material P such as a sheet of paper into the secondary transfer portion N2, a fixing device 6 for fixing the toner image on the recording material P and so on.

Figure 2:
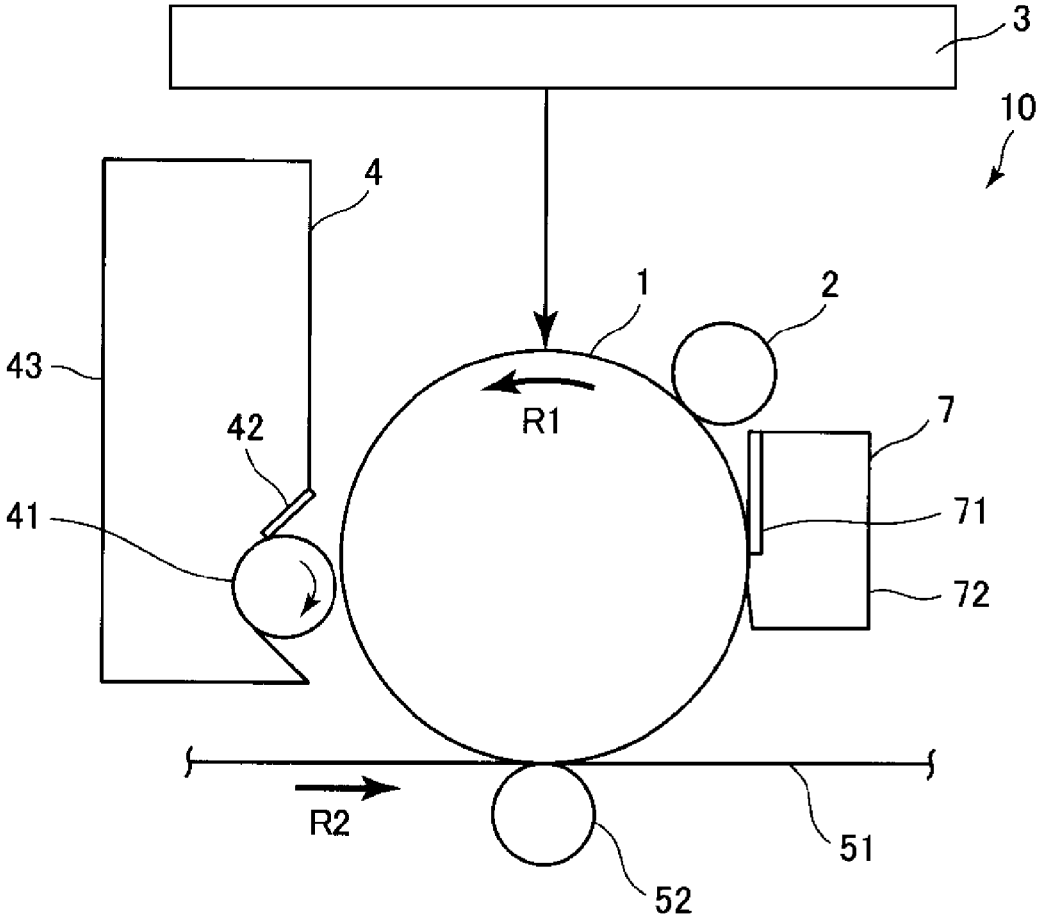
FIG. 2 is a schematic sectional view.

FIG. 2 is a schematic sectional view of exemplary one of the image forming stations S. The process cartridge 10 includes the photosensitive drum 1, a charging roller 2 which is a roller type charging member as charging means, a developing device 4 as developing means, and a cleaning device 7 as cleaning means.

Figure 5:
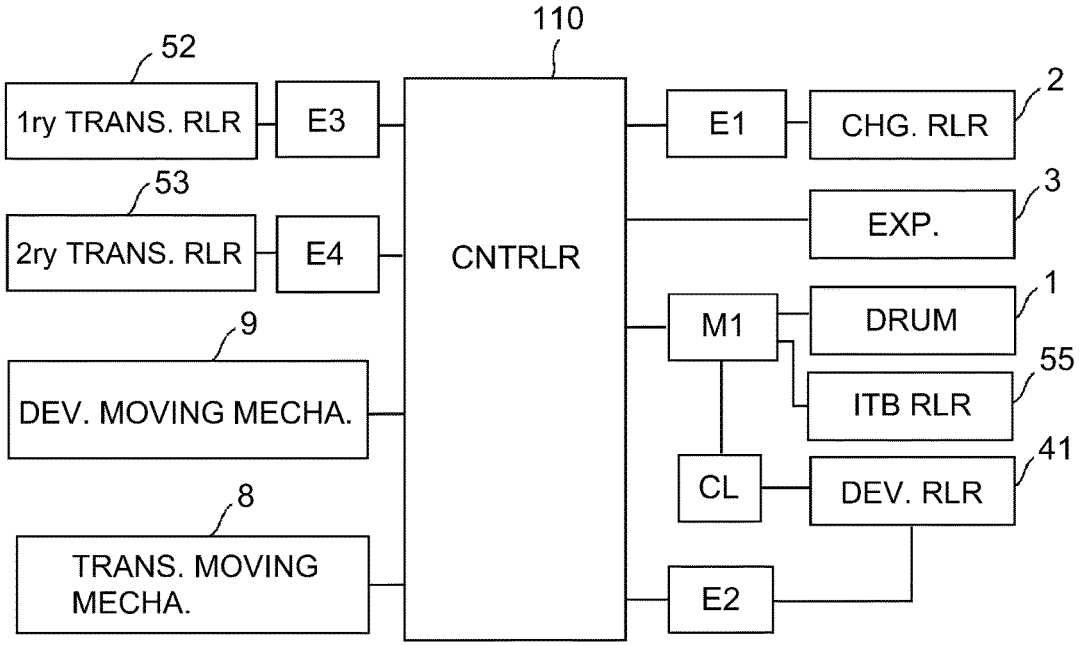
FIG. 5 is a block diagram of a control of major parts of the image forming apparatus.

In this embodiment, the photosensitive drums 1Y, 1M, 1C and 1K of all of the image forming stations SY, SM, SC and SK are rotated by a common driving motor (main motor) M1 (FIG. 5). That is, by actuating and deactuating the single driving motor M1, all of the photosensitive drums 1Y, 1M, 1C and 1K are rotated and stopped. By this, the image forming apparatus 100 may be simplified and less expensive as compared with the photosensitive drums are driven by respective driving motors. In this embodiment, the intermediary transfer belt 51 is also driven by the common driving motor M1.

During the image forming operation, the surface of the rotating photosensitive drum 1 is uniformly charged to a predetermined polarity (negative in this embodiment) and a predetermined potential. At this time, the charging roller 2 is supplied with a predetermined charging voltage (charging bias voltage) from a charging voltage source E1 (FIG. 5) as charging voltage applying means. The surface of the charged photosensitive drum 1 is scanned with a beam in accordance with image information by the exposure device 3 so that an electrostatic latent image (electrostatic image) is formed. The electrostatic latent image formed on the photosensitive drum 1 is developed (visualized) into a toner image by the developing device 4.

In this embodiment, the developing device 4 uses a non-magnetic one component developer (toner) of negative charging property, the developer comprising an externally added material on the surface thereof. The developing device 4 is capable of contacting and being spaced from the image bearing member, and is an example of a developing device for forming an image with the developer on the image bearing member. As shown in FIG. 2, the developing device 4 comprises a developing roller 41 as a developing member (developer carrying member) for carrying the toner, a developing blade 42 for making uniform a toner layer on the developing roller 41, and a developing container 43 accommodating the toner particles including the externally added material on the surface thereof. In the developing containers 43Y, 43M, 43C and 43K of the developing devices 4Y, 4M, 4C and 4K, the yellow, magenta, cyan and black toner particles are contained. In this embodiment, the developing rollers 41Y, 41M, 41C and 41K of all of the developing devices 4Y, 4M, 4C and 4K are driven also by the common driving motor M1 (FIG. 5) for driving all the photosensitive drums 1Y, 1M and 1C. In drive transmission paths from the driving motor M1 to the respective developing devices 4Y, 4M, 4C and 4K, clutch mechanisms CL (FIG. 5) are provided to switch ON/OFF the drive transmissions to the developing devices 4Y, 4M, 4C and 4K. In the developing device 4, the toner carried on the developing roller 41 is fed into the contact portion (developing portion) between the photosensitive drum 1 and the developing roller 41, by the rotation of the developing roller 41. Then, the toner transfers onto the photosensitive drum 1 from the developing roller 41 in accordance with the electrostatic latent image (electrostatic image) on the photosensitive drum 1. By this, the electrostatic latent image is developed (visualized) into a toner image on the photosensitive drum 1. At this time, the developing roller 41 is supplied with a predetermined developing voltage (developing bias voltage) from a developing voltage source E2 (FIG. 5) as development voltage applying means. In this embodiment, the toner image is formed by the image portion exposure and the reverse development. More particularly, by the exposure after the uniform charging, the absolute value of the potential is lowered by the projection of the beam, and the toner charged to the same polarity as the charge polarity of the photosensitive drum 1 is deposited on the lowered potential portion.

The toner image formed on the photosensitive drum 1 is transferred (primary-transfer) onto the rotating intermediary transfer belt 51 by the function of the primary transfer roller 5 in the primary transfer portion N1. At this time, the primary transfer roller 5 is supplied with a primary transfer voltage (primary transfer bias) which is a DC voltage of a polarity opposite to the charge polarity of the toner (regular charge polarity) in the development, from a primary transfer voltage source E3 (FIG. 5) as primary transfer voltage applying means. In the case of the full-color image formation, the toner images formed on the photosensitive drums 1Y, 1M, 1C and 1K are sequentially and superimposedly transferred onto the intermediary transfer belt 51 in the primary transfer portion N1. The superimposed toner images transferred onto the intermediary transfer belt 51 are transferred onto the recording material P (secondary-transfer) fed by being nipped between the intermediary transfer belt 51 and the secondary transfer roller 53, by the function of the secondary transfer roller 53 in the secondary transfer portion N2. At this time, the secondary transfer roller 53 is supplied with a secondary transfer voltage (secondary transfer bias voltage) which is a DC voltage of the polarity opposed to the regular charge polarity of the toner from a secondary transfer voltage source E4 (FIG. 5) as secondary transfer voltage applying means.

The recording material P having the transferred toner image is fed into the fixing device 6 and is subjected to heat and pressure there so that the toner image is fixed on the recording material P. Thereafter, the recording material P is discharged to an outside of the main assembly of the image forming apparatus 100.

On the other hand, the toner (primary-untransferred toner) remaining on the surface of the photosensitive drum 1 after the primary transfer step is removed and collected from the surface of the photosensitive drum 1 by the cleaning device 7. The cleaning device 7 scrapes the primary-untransferred toner off the surface of the rotating photosensitive drum 1 by a cleaning blade 71 as a cleaning member contacted to the photosensitive drum 1 and collects the scraped toner into a collection container 72. The portion of the cleaning blade 71 contacting to the photosensitive drum 1 is made of elastic (urethane rubber blade in this embodiment) plate. The operation timings of operations of a part during the image forming operation will be described hereinafter for respective image forming modes.

2. Contacting/Spacing Mechanism of Transferring Device:

The image forming apparatus 100 of this embodiment is operable in a full color mode for forming the images by all of the image forming stations SY, SM, SC and SK and in a monochromatic mode in which the image is formed and only in the K image forming station, and no image is formed in the YMC image forming stations SY, SM and SC.

Figure 3:
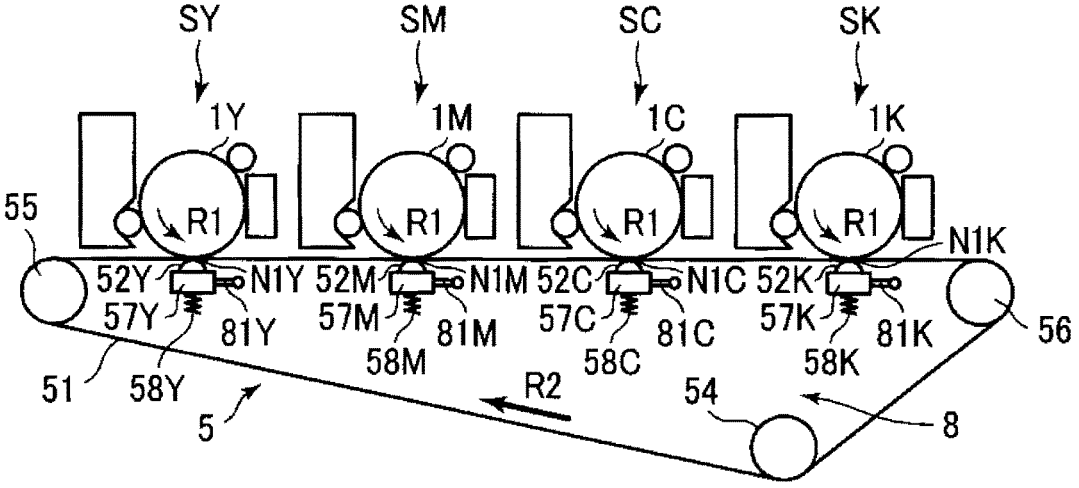
FIG. 3 is a schematic view illustrating the operation of a transfer spacing/contacting mechanism.
Figure 3:
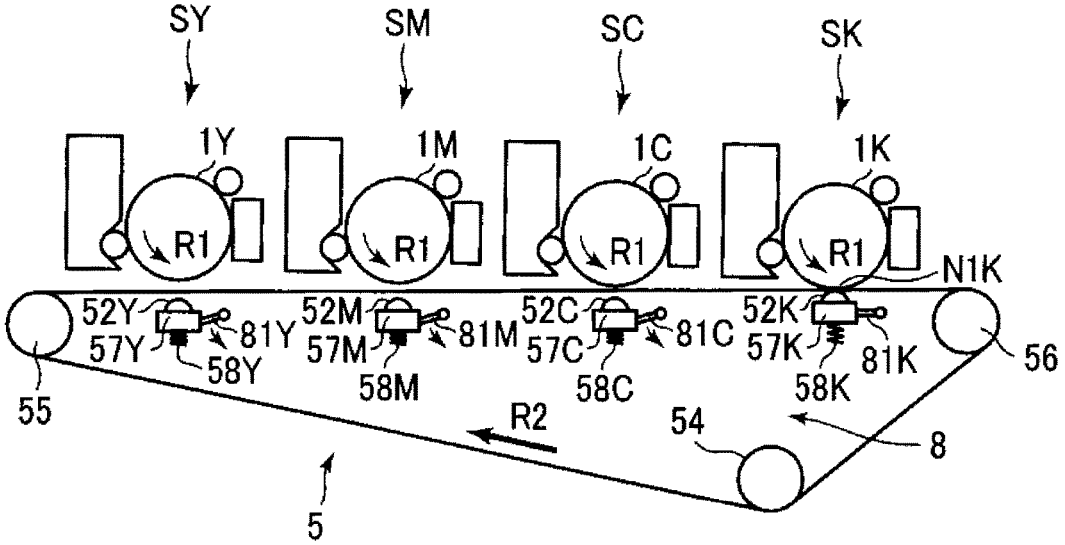

As shown in part (a) of FIG. 3, in the full color mode, the intermediary transfer belt 51 is contacted to all of the photosensitive drums 1Y, 1M, 1C and 1K of the image forming stations SY, SM, SC and SK. As shown in part (b) of FIG. 3, in the monochromatic mode, the intermediary transfer belt 51 is contacted to the photosensitive drum 1K of the K image forming station SK in principle, and the intermediary transfer belt 51 is spaced from the photosensitive drums 1Y, 1M and 1C of the YMC image forming stations SY, SM and SC.

Here, the primary transfer roller 5 is rotatably supported by the bearing members 57 at the opposite longitudinal (axial) end portions. The bearing members 57 are supported slidably toward and away from the photosensitive drum 1. The bearing member 57 is urged toward the photosensitive drum 1 by springs 58 as urging means, so that the primary transfer roller 5 is urged toward the photosensitive drum 1.

The image forming apparatus 100 comprises a transfer contacting/spacing mechanism 8 as changing means for changing the contact pressure between the photosensitive drum 1 and the transferring device 5 by contacting and spacing the intermediary transfer belt 51 relative to the photosensitive drum 1. In this embodiment, the transfer contacting/spacing mechanism 8 includes a movable member 81 for moving the bearing members 57 of the primary transfer roller 52 of the image forming station S away from the photosensitive drum 1. The movable member 81 is operated by an unshown transfer contacting/spacing motor as transfer contacting/spacing drive means. Thus, in this embodiment, the transfer contacting/spacing mechanism 8 as the changing means moves the primary transfer roller 52 as an urging member toward and away from the photosensitive drum 1, by which the contact pressure between the photosensitive drum 1 and the intermediary transfer belt 51 is changed.

In the full color mode, none of the bearing members 57 of the image forming stations SY, SM, SC and SK is moved by the movable members 81 of the transfer contacting/spacing mechanism 8. In this state, as described hereinbefore, the bearing members 57 are arranged by the springs 58, so that the intermediary transfer belt 51 is contacted to the photosensitive drums 1 at a predetermined contact pressure in the primary transfer portions N1. On the other hand, in the monochromatic mode, the bearing members 57 are moved in the direction away from the photosensitive drum 1 by the movable members 81 of the transfer contacting/spacing mechanism 8 in the YMC image forming stations SY, SM and SC. In this state, the contact state between the primary transfer belt 51 and the photosensitive drum 1 through the intermediary transfer belt 51 is released, and in this embodiment, the primary transfer roller 52 is spaced from the inner surface of the intermediary transfer belt 51. In this embodiment, at this time, the position of the driving roller 55 of the intermediary transfer belt 51 is changed, so that the intermediary transfer belt 51 is not contacted to the photosensitive drums 1 in the YMC image forming stations SY, SM and SC. In this embodiment, using the transfer contacting/spacing mechanism 8, the intermediary transfer belt 51 can be spaced from the photosensitive drum 1 in the K image forming station SK, but this is not inevitable to the present invention.

In this manner, in this embodiment, the intermediary transfer belt 51 is spaced from the photosensitive drums 1 of the YMC image forming stations SY, SM, SC in the monochromatic mode operation. By this, the frequency of the contact between the photosensitive drum 1 and the intermediary transfer belt 51 is reduced in the YMC image forming stations SY, SM, SC, thus reducing the surface rubbing of the photosensitive drum 1.

3. Contacting/Spacing Mechanism of Developing Device:

The image forming apparatus 100 of this embodiment is operable in the full color mode and in the monochromatic mode. In the full color mode, the developing rollers 41 of the developing devices 4 of all of the image forming stations SY, SM, SC, SK are contacted to the photosensitive drum 1. On the other hand, in the monochromatic mode, the developing roller 41 of developing devices 4 of the K image forming station SK is contacted to the photosensitive drum 1, but the developing rollers 41 of the developing devices 4 of the YMC image forming stations SY, SM, SC are spaced from the photosensitive drum 1.

Therefore, the image forming apparatus 100 is provided with a development moving mechanism 9 for connecting and spacing the developing roller 41 relative to the photosensitive drum 1 as contacting/spacing operation means for contacting and spacing the developing device 4 relative to the photosensitive drum 1. In this embodiment, the development moving mechanism 9 includes a first contacting/spacing mechanism portion for contacting and spacing the developing rollers 41 relative to the associated photosensitive drums 1 of the YMC image forming stations synchronously (substantially simultaneously). The development moving mechanism 9 includes a second contacting/spacing mechanism portion for contacting and spacing the developing roller 41 relative to the photosensitive drum 1 of the K image forming station SK, independently from the YMC image forming stations SY, SM, SC.

Figure 4:
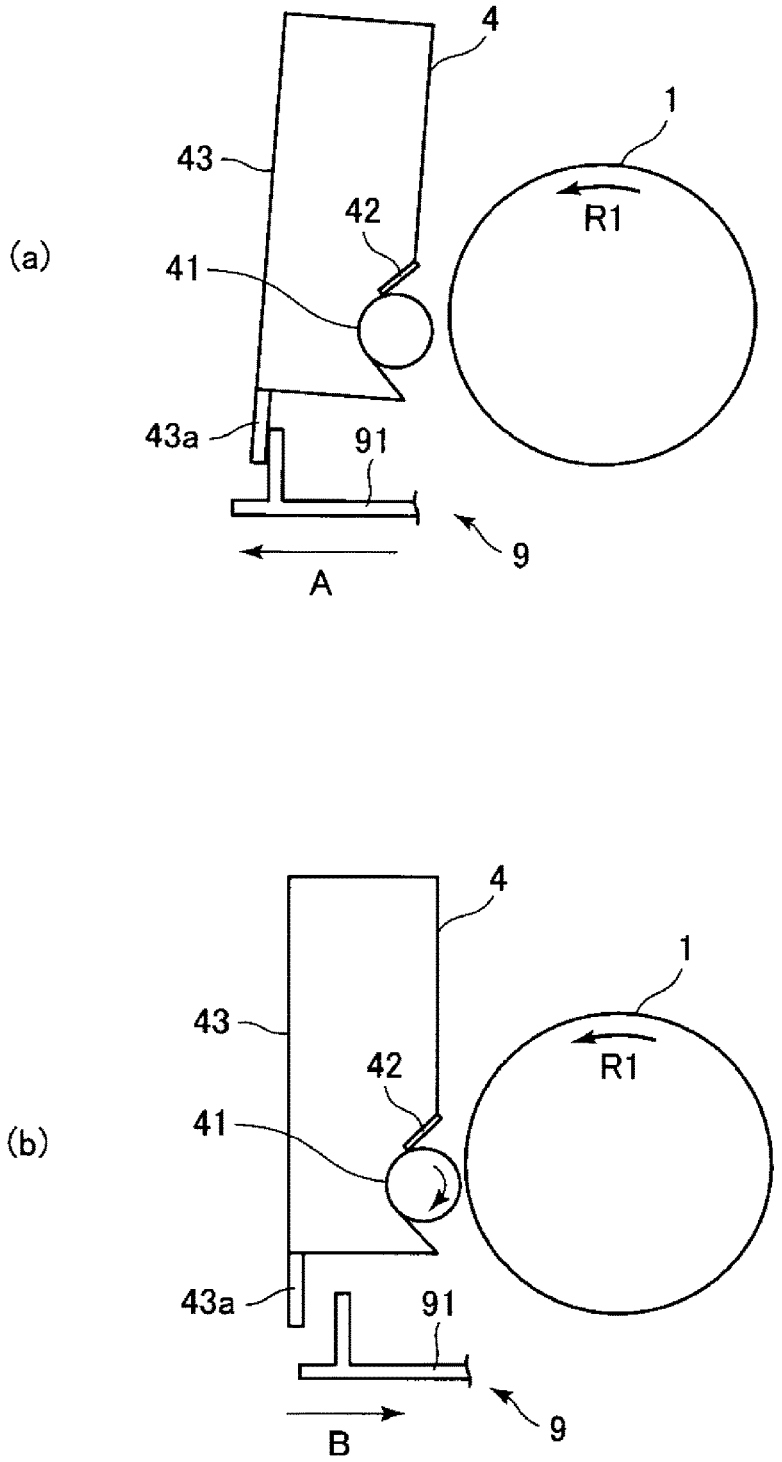
FIG. 4 is a schematic view illustrating an operation of a development spacing/contacting mechanism.

FIG. 4 illustrates an operation of the development moving mechanism 9 in an exemplary one of image forming stations S. The development moving mechanism 9 includes a movable member 91 actable on a receiving portion 43*a* provided on the developing container 43. The movable member 91 is operated by an unshown development separation contact motor as development separation contact driving means. The developing container 43 is swingably supported by the process cartridge 10 and is urged in a direction of contacting the developing roller 41 to the photosensitive drum 1 by a spring (unshown) as urging means. As shown in part (a) of FIG. 4, in spacing the developing roller 41 from the photosensitive drum 1, the movable member 91 is moved in a direction indicated by an arrow A in the Figure, by which the receiving portion 43*a* of the developing container 43 is moved to rotate the developing container 43 against the urging force of the spring. On the other hand, as shown in part (b) of FIG. 4, in contacting the developing roller 41 to the photosensitive drum 1, the movable member 91 is moved in a direction indicated by an arrow B, by which the receiving portion 43*a* is released from the movable member 91, and therefore, the developing container 43 is rotated by the urging force of the spring.

In this embodiment, the home position of the developing device 4 is in the position in which the developing roller 41 is spaced from the photosensitive drum 1. That is, the developing roller 41 is contacted to the photosensitive drum 1 at predetermined timing so that they are contacted with each other substantially only during the developing operation. In this embodiment, when the developing roller 41 is spaced from the photosensitive drum 1, the drive transmission from the driving motor M1 is stopped by the clutch mechanism CL (FIG. 5), so that the rotation stops. When the developing roller 41 is contacted to the photosensitive drum 1, the drive transmission from the driving motor M1 is connected by the clutch mechanism CL, by which the developing roller 41 is rotated.

In this manner, in this embodiment, in the monochromatic mode, the developing roller 41 is spaced from the photosensitive drums 1 of the YMC image forming stations SY, SM, SC in which no image is to be formed. By this, in the YMC image forming stations SY, SM, SC, the frequency of the contact between the photosensitive drum 1 and the developing roller 41 and the frequency of the rubbing between the toner particles in the contact portion between the developing roller 41 and the photosensitive drum 1 can be reduced. As a result, the deteriorations of the photosensitive drum 1 and/or the developing roller 41 and the deterioration of the toner in the developing device 4 can be suppressed, and in addition, the consumption of the deteriorated toner due to deposition thereof onto the white background of the image) can be suppressed.

4. Control Manner:

FIG. 5 is a block diagram of controls of the major parts of the image forming apparatus 100 in this embodiment. The image forming apparatus 100 comprises a controller 110 as controlling means for overall control of the image forming apparatus 100. The controller 110 comprises a central element CPU, and storing elements ROM, RAM. The RAM stores detection results of sensors and results of processing, and the ROM stores control programs and predetermined data tables. In this embodiment, the controller 110 is connected with high voltage sources E1, E2, E3 and E4, the exposure device 3, the driving motor (main motor) M1, the transfer contacting/spacing mechanism 8, the development moving mechanism 9 and so on. In this embodiment, the controller 110 executes the contacting/spacing operation of the intermediary transfer belt 51 in the monochromatic mode operation as will be described hereinafter.

Figure 6:
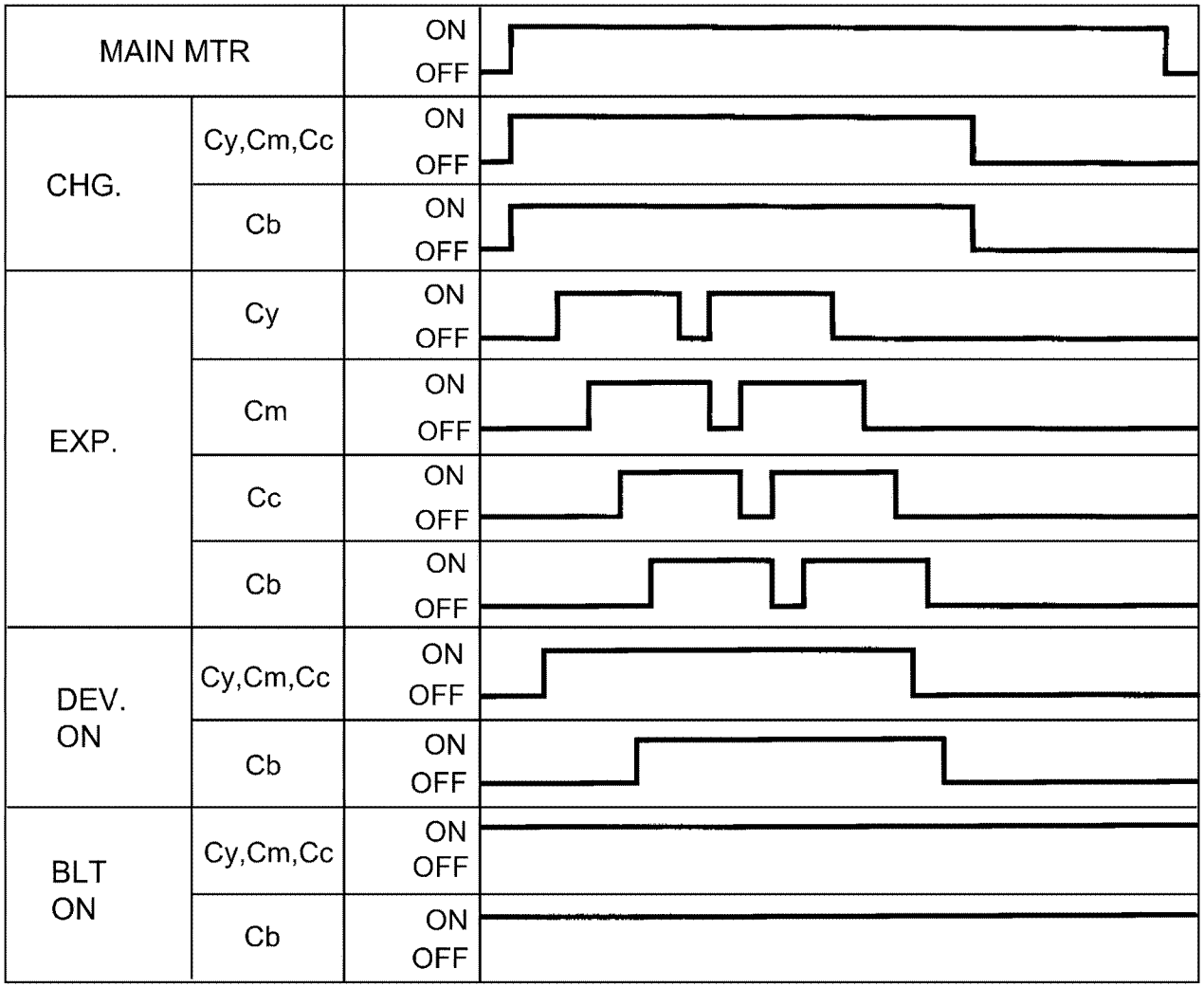
FIG. 6 is a timing chart in a full color mode operation.

5. Image Forming Process in the Full Color Mode:

FIG. 6 is a timing chart for the operation in the full color mode. This timing chart deals with the case in which two image formations are carried out in one job.

When the full-color image forming signal is produced, the controller 110 starts the driving of the main motor M1. By this, the photosensitive drums 1 of all of the image forming stations SY, SM, SC and SK and the intermediary transfer belt 51 simultaneously start rotation.

Simultaneously with the start of the operation of the main motor M1, the controller 110 starts the application of the charging bias voltage to the charging roller 2 of each of the image forming stations SY, SM, SC, SK.

The controller 110 starts the image forming process operation, and the developing rollers 41 are contacted to the photosensitive drum 1 in the YMC image forming stations SY, SM and SC and in the K image forming station SK, as well. The contacting operation is carried out at the predetermined timing after the surface of the photosensitive drum 1 properly charged by the charging roller 2 passes the position where the surface is closest to the developing device 4. Simultaneously with the contacting operation for the YMC image forming stations SY, SM, SC and the K image forming station SK, the controller 110 transmits the power from the main motor M1 to the developing device 4 through the clutch mechanism CL to rotate each of the developing rollers 41.

Then, in each of the image forming stations SY, SM, SC, SK, the controller 110 controls the laser beam to be emitted from the exposure device 3 at the predetermined timing to expose the surface of the photosensitive drum 1 to form an electrostatic latent image. The electrostatic latent image is developed into a toner image (developer image) by supplying the toner to the electrostatic latent image from the developing roller 41. Thereafter, the toner image formed on the photosensitive drum 1 is primary-transferred onto the intermediary transfer belt 51 by the primary transfer bias voltage applied to the primary transfer roller 52.

Then, after the completion of the formation of the toner image on the photosensitive drum 1, in the YMC image forming stations SY, SM, SC and K image forming station SK, the controller 110 spaces the developing rollers 41 from the photosensitive drums 1. Thereafter, the controller 110 stops the application of the charging bias voltages to the charging rollers 2 in all of the image forming stations SY, SM, SC and SK. Thereafter, the controller 110 stops the main motor M1 after the completion of all of the process including the secondary-transfer and the image fixing.

Figure 7:
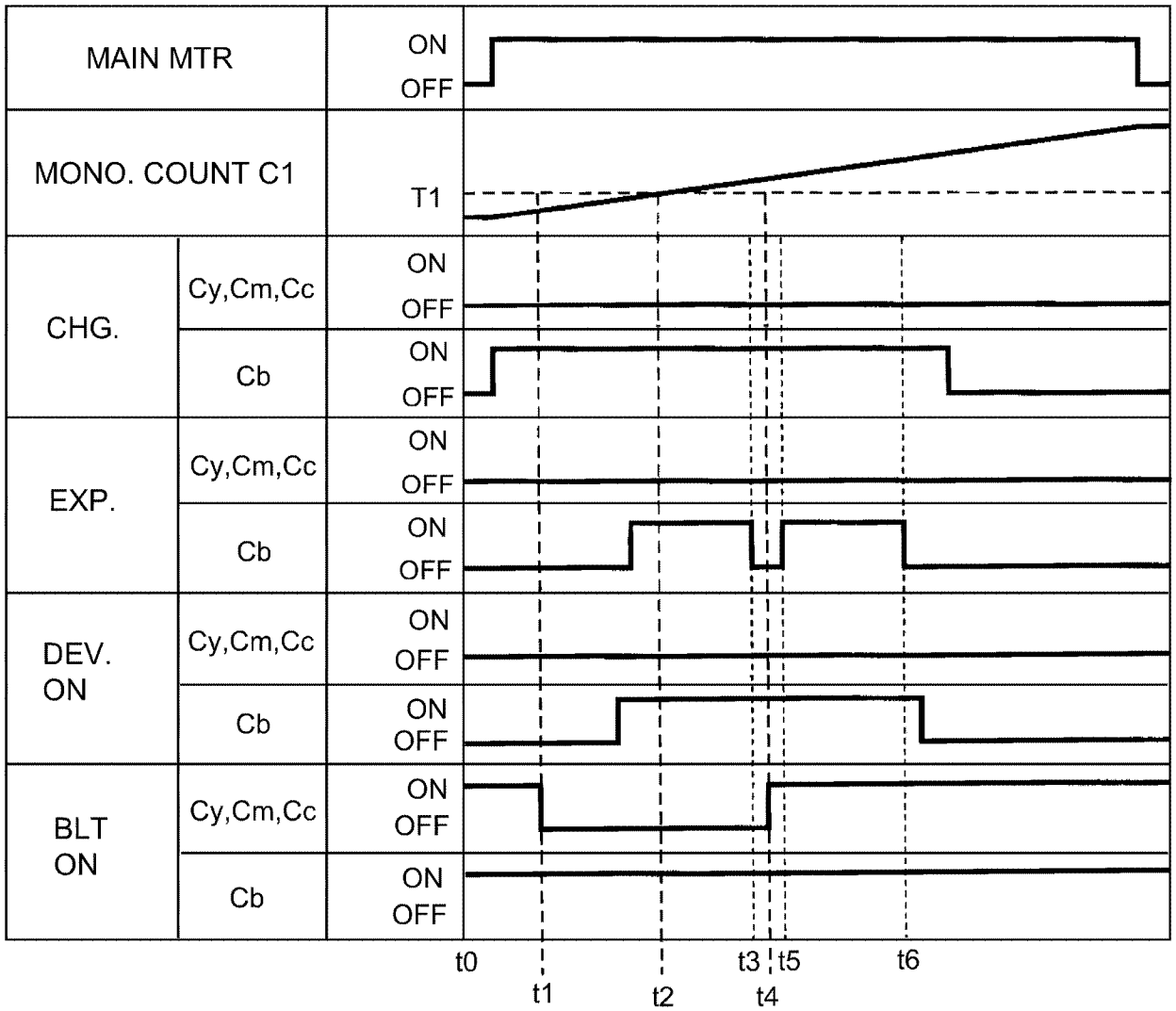
FIG. 7 is a timing chart in the monochromatic mode operation.
Figure 8:
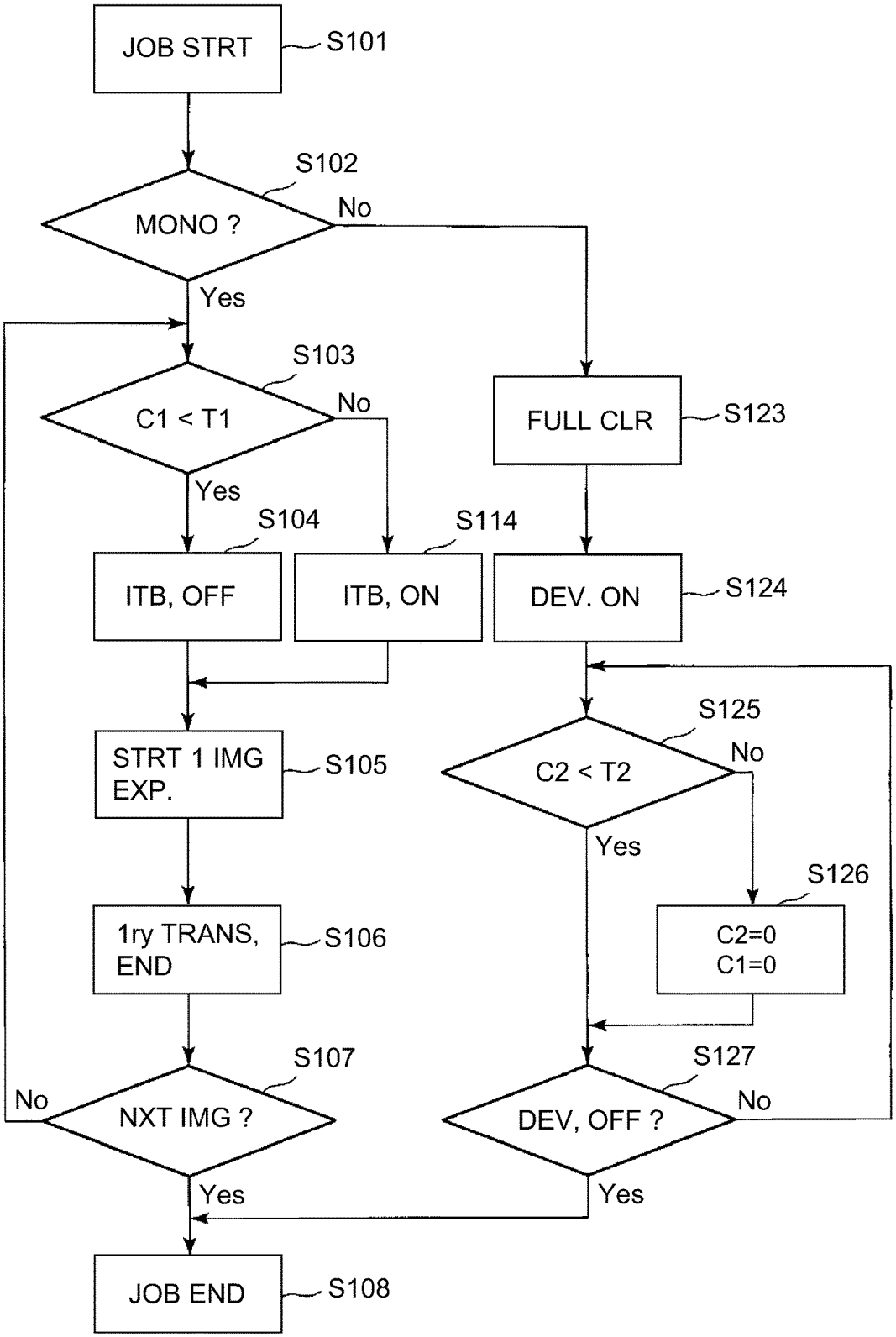
FIG. 8 is a flow chart of an operation for an image formation job.

6. Image Forming Process in Monochromatic Mode:

FIG. 7 is a timing chart for a monochromatic mode operation. Similarly to FIG. 6, the timing chart of FIG. 7 deals with the case in which two image formations are carried out in one job. FIG. 8 is a flow chart for an image formation job in this embodiment. Referring to the timing chart of FIG. 7 and flow chart of FIG. 8, the monochromatic mode operation will be described.

When an image signal is produced at the timing t0, the controller 110 starts the operation for the job (S101). At this time, the controller 110 discriminates whether to execute the full color mode operation or the monochromatic mode operation, on the basis of the image information (S102). In the following, the monochromatic mode will be described (Yes at S102).

When the job operation starts, the controller 110 starts the driving of the main motor M1, similarly to the case of the full color mode operation. By this, all of the photosensitive drums 1Y, 1M, 1C and 1K and the intermediary transfer belt 51 start to rotate substantially simultaneously.

Simultaneously with the start of the driving of the main motor M1, the controller 110 starts the application of the charging bias voltage to the charging roller 2 in the K image forming station SK. On the other hand, no charging bias voltage is applied to the charging rollers 2 of the YMC image forming stations SY, SM, SC because they are not used for the image formation.

Simultaneously with the main motor M1 being driven, the controller 110 stores an index (monochromatic count C1) indicative of the degree of use of the photosensitive drum 1 in the monochromatic mode in a memory as the storing means. In this embodiment, the controller 110 calculates a movement distance of the surface of the photosensitive drum 1 from the number of rotations of the photosensitive drum 1 on the basis of the process speed, and renews the monochromatic count C1 every 10 mmsec. In this embodiment, the monochromatic count C1 which is the information relating to the use amount of the photosensitive drum 1 is acquired as the number of rotations of the photosensitive drum 1. That is, the information relating to the use amount of the photosensitive drum 1 is calculated from the number of rotations of the photosensitive drum 1. However, this method is not inevitable to the present invention, and in an alternative, an operation time is simply taken, which may be weighted depending on a parameters such as the image size and/or continuous printing number. Any index relating to the use amount (rotation amount) of the photosensitive drum 1 is usable.

In the controller 110, a predetermined threshold (monochromatic threshold T1) is set for the monochromatic count C1. The monochromatic threshold (first threshold) T1 is empirically determined as the time duration of the monochromatic mode operation until the vibration of the cleaning blade 71 becomes large and the cleaning blade noise begins. The monochromatic threshold T1 is determined with a predetermined margin in consideration of time lags and errors under various conditions. In this embodiment, the threshold T1 is determined as the number of rotations of the photosensitive drum 1 corresponding to 80 continuous letter size images.

Then, prior to the start of toner image forming process including the exposing operation and the contacting operation in the developing device 4, the controller 41 compares the monochromatic count C1 and the monochromatic threshold T1 (S103) at the timing t1. In the timing t1, the monochromatic count C1 is lower than the monochromatic threshold T1 (Yes in S103), and therefore, the intermediary transfer belt 51 is spaced from the photosensitive drum 1 in each of the YMC image forming stations SY, SM and SC.

Then, the controller 110 executes the toner image forming process including the exposing operation and the contacting operation in the developing device 4 in the K image forming station (S105), similarly to the case of full color mode operation. On the hand, as for the YMC image forming stations SY, SM and SC, the controller 110 does not execute the toner image forming process.

The controller 110 renews the monochromatic count C1 during the rotation of the photosensitive drum 1 in the monochromatic mode operation. In the timing chart of FIG. 7, at the timing t2 during the period of the toner image formation and the primary-transfer for the first image, the monochromatic count C1 reaches the monochromatic threshold T1.

Thereafter, the image exposure for the first image is completed at the timing t3. As for the primary transfer step for the first image, it is completed substantially simultaneously (more particularly, at the time when the exposure end position on the photosensitive drum passes the primary transfer portion). In this example, two images are formed, and therefore, the operation proceeds to the toner image forming process for the second image formation (No in S107).

In this example, upon the proceeding to the second image formation process, the controller 110 compares the monochromatic count C1 and the monochromatic threshold T1, again (S103), at the timing t4 before the start of the toner image forming process (more particularly, the exposing operation) for the second image. In this example, the monochromatic count C1 exceeds the monochromatic threshold T1 (Yes in S103), and therefore, the controller 110 brings the intermediary transfer belt 51 into contact to the photosensitive drum 1 in the YMC image forming stations SY, SM and SC (S114), despite that the monochromatic mode operation is in the process.

Thereafter, the toner image forming process is carried out for the second image from the timing t5 to the timing t6. In this example, two image forming operations are carried out, and therefore, the entire image forming operations for the job are completed at timing t6 substantially simultaneously with the completion of the image exposure for the second image (more particularly, at the time when the exposure end position of the photosensitive drum passes the primary transfer portion) (Yes in S107).

After the completion of the formation of the toner image on the photosensitive drum 1 in the K image forming station SK, the controller 110 spaces the developing roller 41 from the photosensitive drum 1. Thereafter, the controller 110 stops the application of the charging bias voltage to the charging roller 2 in the K image forming station SK. Thereafter, the controller 110 stops the main motor M1 to complete the image formation job (S108), after the completion of all of the process including the secondary-transfer and the fixing is completed.

The contacting operation of the intermediary transfer belt 51 to the photosensitive drum 1 in the YMC image forming stations SY, SM, SC in the monochromatic mode operation is preferably carried out in the period other than the period of the primary-transfer operation in the K image forming station SK. In this embodiment, as described, the contacting operation is not carried out at the timing t2 of the monochromatic count C1 reaching the monochromatic threshold T1. The contacting operation is carried out at the timing t4 in which the image exposure and primary transfer step for the first image are completed. By doing so, it can be avoided that the impact caused by the contacting operation of the intermediary transfer belt 51 to the photosensitive drum 1 during the primary-transfer of the toner image onto the intermediary transfer belt 51 from the photosensitive drum 1 in the K image forming station SK adversely affects the formation of the first image. Furthermore, the contacting operation is preferably carried out in a period other than the period in which the image exposure by the exposure device 3 is carried out in the K image forming station SK. In this embodiment, as described hereinbefore, the contact operation is carried out at the timing t4 which is before the start of the image exposure step for the second image. By this, the disturbance to the image formation on the photosensitive drum 1 in the K image forming station SK due to the vibration or the like can be avoided.

In this manner, in this embodiment, in the YMC image forming stations SY, SM, SC in which no image forming operation is carried out in the monochromatic mode, the developing roller 41 and the intermediary transfer belt 51 are spaced from the photosensitive drums 1. By this, in the YMC image forming stations SY, SM, SC, the toner deterioration in the developing device 4, toner consumption and the scraping of the surface of the photosensitive drum 1 can be suppressed. However, in this embodiment, this state continues for a predetermined period, more particularly, when the state continues to such an extent that the monochromatic count C1 exceeds the monochromatic threshold, the intermediary transfer belt 51 is contacted to the photosensitive drums 1 in the YMC image forming stations SY, SM, SC, even in the monochromatic mode operation. By this, even when the frictional force between the cleaning blade 71 and the photosensitive drum 1 increases in the YMC image forming stations SY, SM, SC, the vibration of the cleaning blade 71 can be suppressed by the intermediary transfer belt 51 through the photosensitive drum 1. Therefore, the production of the cleaning blade noise can be suppressed, and the lifetimes of the cartridges 10 including the YMC image forming stations SY, SM, SC can be extended.

6. Reset of Monochromatic Count C1:

Referring to FIG. 8, again, the description will be made as to the condition for resetting the monochromatic count C1.

As described hereinbefore, the monochromatic count C1 is renewed successively while the photosensitive drum 1 is rotated in the monochromatic mode operation. On the other hand, when the controller 110 discriminates that no monochromatic operation is carried out (No in S102), the full color mode is carried out (S123). In this case, the image forming operation is carried out with the developing roller 41 contacted to the photosensitive drum 1 in the YMC image forming stations SY, SM and SC (S124).

The controller 110 successively stores an index (development contact count C2) indicative of the degree of contact of the developing roller 41 (YMC image forming stations SY, SM, SC) to the associated photosensitive drum 1 in the full color mode operation. In this embodiment, the controller 110 calculates movement distance of the surface of the photosensitive drum 1 using the number of rotations of the photosensitive drum 1 on the basis of the process speed, and renews the development contact count C2 every 10 mmsec. Similarly to the monochromatic count C1, monochromatic development contact count C2 which is the information relating to the use amount of the photosensitive drum 1 in contact with the developing roller 41 is not limited to the value as the movement distance of the surface of the photosensitive drum 1 calculated from the number of rotations. The controller 110 sets a predetermined value as the predetermined threshold (development contact threshold T2) for the development contact count C2.

In the YMC image forming stations SY, SM, SC, the development contact count C2 is successively incremented as long as the developing roller 41 is in contact with the photosensitive drum 1 (No, in S127). When the development contact count C2 exceeds the development contact threshold T2 (No in S125), the controller 110 resets the development contact count C2 and the monochromatic count C1.

As described hereinbefore, the cleaning blade noise is produced in the monochromatic mode operation for the following reason. In the case that the developing roller 41 is spaced from the photosensitive drum 1 for a long-term in the YMC image forming stations SY, SM and SC, the supply of the toner and externally added material as the lubricant into the contact portion between the photosensitive drum 1 and the cleaning blade 71 is not carried out for the long-term. In view of this, the degree of the non-supply of the toner and externally added material is deduced from the monochromatic count C1. On the other hand, if the developing roller 41 is contacted to the photosensitive drum 1 for a certain period of time, an amount of the toner and externally added material is supplied into between the cleaning blade 71 and the photosensitive drum 1. Therefore, the degree of the supply of the toner and externally added material is deduced from the development contact count C2. When the development contact count C2 exceeds the predetermined development contact threshold T2, it is discriminated that a sufficient amount of the lubricant is supplied into between the photosensitive drum 1 and the cleaning blade 71, and therefore, the monochromatic count C1 and the development contact count C2 are reset.

In view of the above-described reason, the development contact count C2 may be incremented also when the developing roller 41 is in contact with the photosensitive drum 1 during the predetermined control operation such as toner discharge control operation, as well as the full color mode operations. The toner discharge control is the control in which a predetermined amount of the toner is transferred onto the photosensitive drum 1 and removed by the cleaning device 7 periodically at predetermined intervals, for example, to prevent the accumulation of the deteriorated toner in the developing device 4.

In this embodiment, the development contact threshold (second threshold) T2 is determined to correspond to the number of rotations of the photosensitive drum 1 corresponding to two continuous image formations on letter size sheets.

The structures of this embodiment are summarized as follows. In the monochromatic mode (special mode) operation, the image is formed using the photosensitive drum 1 only of the black image forming station SK. Therefore, in the yellow, magenta and cyan image forming stations SY, SM and SC not operated in the monochromatic mode operation, the developing rollers 41 are spaced from the photosensitive drums 1, and the intermediary transfer belt 51 of the transferring device 5 is spaced from the photosensitive drums 1. By doing so, the load applied to the photosensitive drums 1, the developing rollers 41 and the toner in the yellow, magenta and cyan image forming stations (image forming stations used only in the full color mode operation) can be reduced. This is effective to extend the lifetimes of the process cartridges 10 including the yellow, magenta and cyan image forming stations SY, SM and SC, respectively.

However, in the monochromatic mode operations, the photosensitive drums 1 of the yellow, magenta and cyan image forming stations SY, SM and SC are spaced from the associated developing rollers 41, and therefore, the toner and/or the externally added material is not supplied from the developing roller 41 to the photosensitive drum 1. If such a state continues long-term, the amount of the toner and/or externally added material existing between the photosensitive drum 1 and the cleaning blade 71 decreases with the result of the increase of the friction between the photosensitive drum 1 and the cleaning blade 71, in each of the yellow, magenta and cyan image forming stations SY, SM, SC. As a result, the noise (cleaning blade noise) may be produced by the vibrations of the photosensitive drum 1 and the cleaning blade 71.

Under the circumstances, according to this embodiment, when the developing roller 41 and/or the intermediary transfer belt 51 is kept out of contact with the photosensitive drum 1 in the yellow, magenta and cyan image forming stations SY, SM, SC for a period exceeding a predetermined period, the intermediary transfer belt 51 is brought into contact to the photosensitive drum 1. By this, the vibration of the photosensitive drum 1 and/or the cleaning blade 71 is suppressed. More particularly, when the use amount (number of rotations (monochromatic count C1)) of the photosensitive drum 1 in the state that the developing roller 41 and/or the intermediary transfer belt 51 are spaced from the photosensitive drum 1 exceeds a predetermined threshold (monochromatic threshold T1), the intermediary transfer belt 51 is brought into contact to the photosensitive drum 1. By doing so, the vibrations of the photosensitive drum 1 and/or the cleaning blade 71 are suppressed, and the production of the noise (cleaning blade noise) can be suppressed.

In this embodiment, in the yellow, magenta and cyan image forming stations SY, SM and SC, the intermediary transfer belt 51 is completely spaced from the photosensitive drum 1 in the monochromatic mode operation. However, this is not inevitable, that is, they may be partly in contact with each other. By reducing the contact pressure between the photosensitive drum 1 and the intermediary transfer belt 51 in the yellow, magenta and cyan image forming stations SY, SM, SC during the monochromatic mode operation, at least the load applied to the photosensitive drum 1 can be reduced. When the image forming operation is switched from the full color mode to the monochromatic mode, the developing roller 41 is spaced from the photosensitive drum 1 in each of the yellow, magenta and cyan image forming stations, so that the contact pressure between the photosensitive drum 1 and the intermediary transfer belt 51 is reduced. When the state continues for the predetermined time period threshold or longer, the contact pressure between the photosensitive drum 1 and the intermediary transfer belt 51 is increased (to the same pressure as in the full color mode), by which the vibration of the cleaning blade 71 and/or the photosensitive drum 1 is suppressed. As described hereinbefore, according to the present invention, when the image forming operation is switched to the monochromatic mode, the photosensitive drum 1 and the intermediary transfer belt 51 are spaced from each other in the yellow, magenta and cyan image forming stations SY, SM, SC. Therefore, the contact pressure between the photosensitive drum 1 and the intermediary transfer belt 51 is reduced to zero. Such a structure is most preferable from the standpoint of reducing the loads applied to the yellow, magenta and cyan photosensitive drums 1.

In this manner, the image forming apparatus 100 of this embodiment is operable in the monochromatic mode in which only a part (SK) of the image forming stations forms the image, and the other image forming stations SY, SM, SC do not form an image. The monochromatic mode operation is carried out in the following state. The developing device 4 contacts to the photosensitive drum 1 in the image forming station SK. In the other image forming stations SY, SM, SC, the developing device 4 is spaced from the photosensitive drum 1, and the contact pressure between the photosensitive drum 1 and the transferring device 5 is made smaller than that in the image forming station SK. The photosensitive drums 1 of the image forming station SK and of the image forming stations SY, SM and SC are rotated. The image forming apparatus 100 comprises controlling means 110 operable such that when the image forming apparatus 100 continues to operate in the monochromatic mode for a time period longer than the predetermined period, the contact pressure in the other image forming stations SY, SM and SC are made larger than the reduced contact pressure. Particularly in this embodiment, the controlling means 110 spaces the transferring device 5 from the photosensitive drum 1 in the other image forming stations SY, SM and SC to reduce the contact pressure in these image forming stations. In addition, in this embodiment, in order to increase the reduced contact pressure on the other image forming stations SY, SM and SC, the transferring device 5 is contacted to the photosensitive drum 1 in these image forming stations.

As described in the foregoing, according to the present invention, the deterioration of the members such as the photosensitive drums 1 in the image forming stations SY, SM and SC not being operated in the monochromatic mode operation can be suppressed, and in addition, the production of the noise caused by the cleaning blade 71 can be suppressed.

Embodiment 2

Another embodiment will be described. The fundamental structures and operations of the image forming apparatus of this embodiment are the same as those of Embodiment 1. In the description of this embodiment, the same reference numerals as in Embodiment 1 are assigned to the elements having the corresponding functions in this embodiment, and the detailed description thereof is omitted for simplicity.

The cleaning blade noise tends to be produced more depending on various conditions including the ambient condition, the degree of use of the developing device 4, the process speed and so on. Therefore, the monochromatic threshold T1 may be changed depending on one or more of the conditions. The monochromatic threshold T1 may be changed depending on at least one of these conditions or by all of these conditions. In this embodiment, as shown in the following Table 1, the controller 110 changes the monochromatic threshold T1 depending on the ambient condition of the image forming apparatus 100, the degree of use of the developing device 4 and the process speed. The values of the monochromatic threshold T1 of Table 1 are the value acquired by converting the number of rotations of the photosensitive drum 1 to the number of images in letter size sheet continuous job.

TABLE 1

| | | Process speed | | |
|---|---|---|---|---|
| | | Normal speed | | Low speed |
| Degree of use (Au) | | Au < Al | Au ≥ Al | — |
| Temp. of Main assembly (T ° C.) | T > 10 | 80 | 30 | 0 |
| | 0 < T ≤ 10 | 30 | 10 | 0 |
| | T ≤ 0 | 0 | 0 | 0 |

In this embodiment, the portion of the cleaning blade 71 which contacts to the photosensitive drum 1 is made of urethane rubber, and therefore, the hardness thereof is higher if the ambient temperature of the image forming apparatus 100 is lower. When the hardness of the cleaning blade 71 is high, the contact pressure between the photosensitive drum 1 and the cleaning blade 71 is high with the result of increase of the cleaning blade noise. In this embodiment, therefore, the image forming apparatus 100 is provided with a temperature sensor 11 (FIG. 1) as ambience detecting means for detecting the ambient condition. The controller 110 decreases the monochromatic threshold T1 with the decrease of the temperature T of the main assembly of the apparatus detected by the temperature sensor 11 (that is, a monochromatic threshold T1 which is smaller than the preset one). In other words, as compared with the case of the first temperature detected by the temperature sensor 11, the monochromatic threshold T1 is smaller in the case of the second temperature lower than the first temperature.

With the use of the developing device 4, the externally added material deposited on the surfaces of the toner particles in the developing device 4 are gradually separated. Then, the amount of the externally added material supplied into the contact portion between the photosensitive drum 1 and the cleaning blade 71 is small with the result of decreased lubricating function, even if the contact time period of the developing roller 41 to the photosensitive drum 1 is the same. In view of this, in this embodiment, the image forming apparatus 100 is provided with detecting means for detecting information Au relating to the use amount of the developing device 4. In this embodiment, the controller 110 has a function of such detecting means. When the information Au relating to the use amount of the developing device 4 reaches a predetermined threshold (development lifetime), the monochromatic threshold T1 is reduced. That is, as compared with the cases of the first use amounts of the developing devices 4 indicated by the information in the YMC image forming stations SY, SM, SC, the monochromatic thresholds T1 are made smaller in the case of the second use amount which is larger than the first use amount. In this embodiment, the information Au relating to the use amount of the developing device 4 and the development lifetime Al are represented by total number of rotations of the developing roller 41. However, the present invention is not limited to such an example, but may be an amount of the toner remaining in the developing device 4, for example. Or, it may be any other index correlated with the degree of the deterioration of the toner particles in the developing device 4.

The process speed of the image forming apparatus may be reduced when an image is formed on a thick sheet which requires long time to fix the image thereon. In such a case, the negative attenuation in which the energy of the vibration gradually increases may arise with the results of worse cleaning blade noise. In view of this, in this embodiment, the controller 110 makes smaller the monochromatic threshold T1 when the image forming apparatus is operated in the low speed mode. In the execution of the monochromatic mode operation, as compared with the case of the first rotational speed of the photosensitive drum 1, the monochromatic threshold T1 is made smaller in the case of the second rotational speed lower than the first rotational speed.

In Table 1, the case of the monochromatic threshold T1=0 is the case of the minimum monochromatic threshold T1. In such a case, taking the example of FIG. 7, the intermediary transfer belt 51 is brought into contact to the photosensitive drums 1 of the YMC image forming stations SY, SM and SC prior to the toner image forming process operation (image exposure and development) for the first image in the monochromatic mode operation.

As described, according to this embodiment, the same advantageous effects as with Embodiment 1 are provided, and in addition, the cleaning blade noise can be more efficiently suppressed depending on the various conditions including one or more of the ambient condition of the image forming apparatus 100, the degree of use of the developing device 4 and the process speed.

[Others]

In the foregoing description, specific examples are taken, but the present invention is not limited to such examples.

In the foregoing embodiments, the monochromatic mode is for forming a monochromatic image using only the black toner, but the present invention is not limited to such an example. It may be a two color mode using only the black toner and the cyan toner, for example, or a three color mode not using only the yellow toner, for example. Even in such a case, similarly to the monochromatic mode described in the foregoing, the cleaning blade noise of the image forming station in which the developing roller is not contacted to the photosensitive drum can be suppressed.

Figure 9:
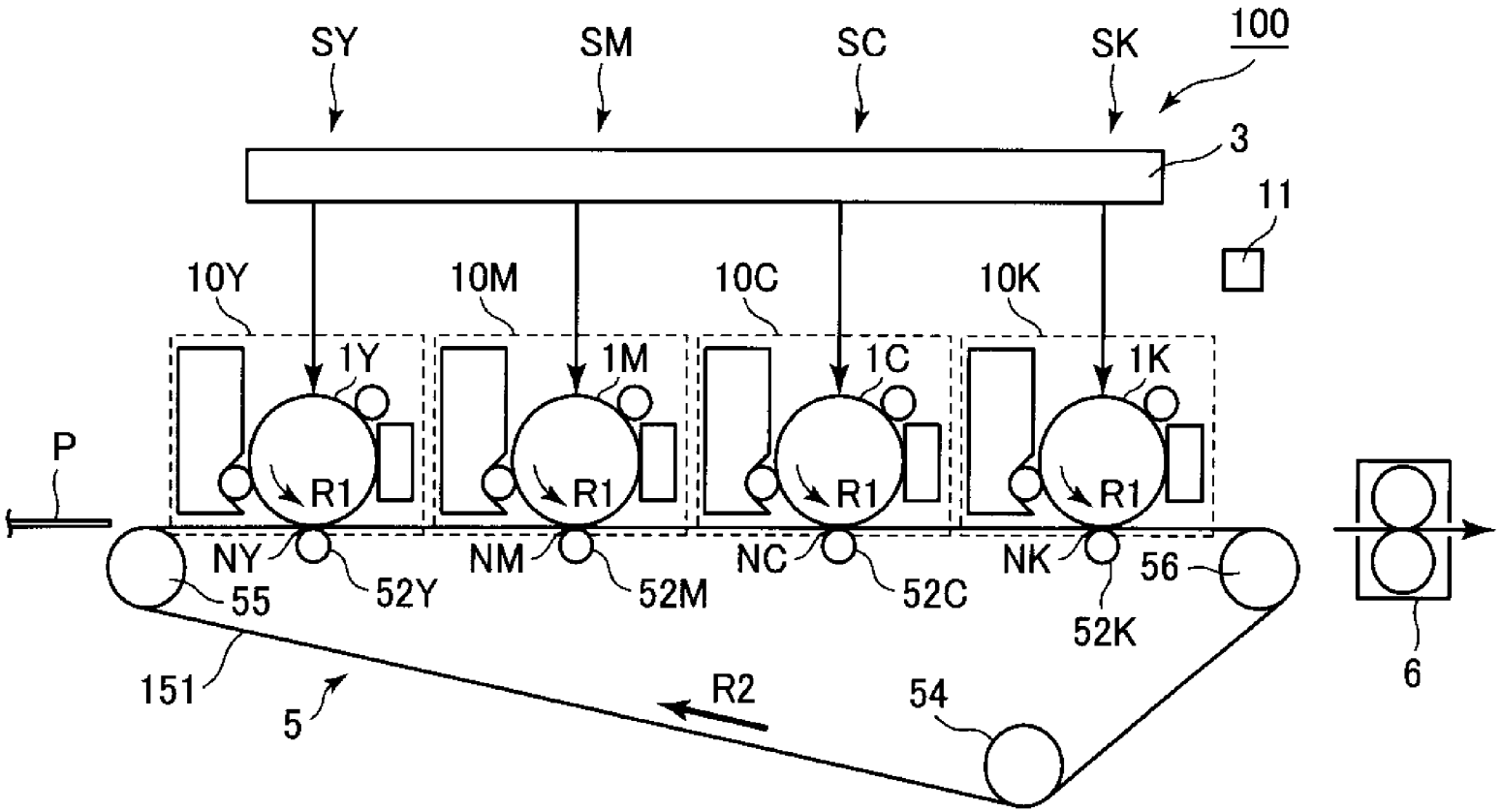
FIG. 9 is a schematic sectional view of an image forming apparatus of another example.

In the foregoing embodiments, the transferring device for transferring the toner image from the photosensitive drum to the recording material uses the intermediary transfer belt. In other words, in the foregoing embodiments, the toner image formed on the photosensitive drum is temporarily transferred onto the intermediary transfer belt (primary-transfer) and then transferred onto the recording material from the intermediary transfer belt. However, the transferring device is not limited to that using the intermediary transfer member. As shown in FIG. 9, for example, an electrostatic feeding belt (ETB) 151 as a recording material carrying member for feeding the recording material may be used in place of the intermediary transfer belt. In the description of FIG. 9 structure, the same reference numerals as in the foregoing embodiments are assigned to the elements having the corresponding functions in this embodiment, and the detailed description thereof is omitted for simplicity. In the case of the image forming apparatus 100 of FIG. 9, the transferring device 5 transfers the toner image from the photosensitive drum 1 directly onto the recording material P or the like paper being conveyed by the electrostatic feeding belt 151. In such an image forming apparatus 100, the electrostatic feeding belt 151 is contacted to the photosensitive drum 1 when the state in which the developing roller 41 and/or the electrostatic feeding belt 151 is spaced from the photosensitive drum 1 continues for a time period longer than the threshold. By doing so, the vibration of the photosensitive drum 1 and/or the cleaning blade 71 is suppressed, and therefore, the production of the noise can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application is a divisional of U.S. patent application Ser. No. 15/067,659, filed Mar. 11, 2016, which claims the benefit of Japanese Patent Application No. 2015-050047 filed on Mar. 12, 2015, both of which are hereby incorporated by reference herein in their entirety.

What is claimed is:

1. An image forming apparatus comprising:

a plurality of image forming stations, each including a rotatable image bearing member and a developing device configured to develop an image on said image bearing member with a developer, wherein said image forming apparatus is operable in a first mode in which the image is formed by only a part of said image forming stations and no image is formed by the rest of said image forming stations, and wherein an image forming operation in the first mode is executed by rotating said image bearing members of the part and the rest of said image forming stations;

a transferring device configured to transfer the images formed on said image bearing members of said image forming stations, wherein in the first mode, the part of said image forming stations is in a contacting state in which said image bearing members contact said transferring device;

a contacting/spacing device provided for the rest of said image forming stations and configured to enable the rest of said image forming stations to be in the contacting state or a spacing state in which said image bearing members are spaced from said transferring device; and a controlling device configured to control said contacting/spacing device such that the rest of said image forming stations is changed into the contacting state after the image forming operation has been executed for a predetermined period in the spacing state.

2. The apparatus according to claim 1, further comprising a storing device for storing information relating to a use amount of said image bearing members, wherein when the information of the rest of said image forming stations exceeds a first threshold, said controlling device controls said contacting/spacing device.

3. The apparatus according to claim 2, wherein when the information of the rest of said image forming stations operated in a second mode with said developing device contacting said image bearing members exceeds a predetermined second threshold, said controlling device resets the information stored in said storing device in the first mode for the rest of said image forming stations.

4. The apparatus according to claim 2, wherein the information is calculated from a number of rotations of said image bearing members.

5. The apparatus according to claim 2, further comprising an ambience detecting device configured to detect an ambient condition of said image forming apparatus, wherein said controlling device changes the first threshold depending on the ambient condition detected by said ambience detecting device.

6. The apparatus according to claim 5, wherein as compared with a case of a first temperature detected by said ambience detecting device, said controlling device makes the first threshold lower in a case of a second temperature which is lower than the first temperature.

7. The apparatus according to claim 2, further comprising a detecting device configured to detect information relating to a use amount of said developing devices of the part of said image forming stations, wherein said controlling device changes the first threshold depending on the developing device use amount of the rest of said image forming stations detected by said detecting device.

8. The apparatus according to claim 7, wherein as compared with a case of a first use amount of the developing devices of the rest of said image forming stations, said controlling device makes the first threshold lower in a case of a second use amount which is greater than the first use amount.

9. The apparatus according to claim 2, wherein said image forming apparatus is operable in a mode with different rotational speeds of said image bearing members, and said controlling device changes the first threshold depending on the rotational speed.

10. The apparatus according to claim 9, wherein as compared with a case of a first rotational speed, said controlling device makes the first threshold lower in a case of a second rotational speed which is slower than the first rotational speed.

11. The apparatus according to claim 1, wherein said transferring device includes an endless belt configured to receive toner images from said image bearing members or configured to carry a recording material onto which the toner images are transferred from said image bearing members, and includes an urging member provided across said belt from said respective image bearing members, wherein said belt is moved by said urging members toward and away from said image bearing members.

12. The apparatus according to claim 11, wherein said urging member comprises a transfer member configured to transfer the toner images from said image bearing members onto said belt or the recording material carried on said belt.

13. The apparatus according to claim 1, wherein said controlling device provides a greater contact pressure in a period other than a period in which the image is being transferred from said image bearing members.

14. The apparatus according to claim 1, wherein said image forming stations each further include a charging device for charging said image bearing member and an exposure device for exposing said image bearing member charged by said charging device to light to form an electrostatic latent image on said image bearing member, wherein said controlling device controls to provide a greater contact pressure in a period other than a period in which said exposure device is exposing said image bearing member to the light to form the electrostatic latent image.

* * * * *